United States Patent [19]

Joekel

[11] 4,103,408

[45] Aug. 1, 1978

[54] METHOD FOR THE COLD WORKING OF HEAT EXCHANGER TUBING FOR THE ATTACHMENT OF SPIRAL FINS

[75] Inventor: Alfred Joekel, Essen-Werden, Fed. Rep. of Germany

[73] Assignee: Balcke-Dürr Aktiengesellschaft, Ratingen, Fed. Rep. of Germany

[21] Appl. No.: 709,130

[22] Filed: Jul. 27, 1976

[30] Foreign Application Priority Data

Jul. 31, 1975 [DE] Fed. Rep. of Germany ..... 2534217

[51] Int. Cl.[2] ..... B23P 15/26

[52] U.S. Cl. ..... 29/157.3 AH; 165/182

[58] Field of Search ..... 29/157.3 AH, 157.3 B, 29/157.3 A, 157.3 R; 165/182

[56] References Cited

U.S. PATENT DOCUMENTS

| | | | |
|---|---|---|---|
| 1,734,136 | 11/1929 | Kramer | 29/157.3 AH |
| 3,100,930 | 8/1963 | Nihlen et al. | 29/157.3 AH |

*Primary Examiner*—C.W. Lanham
*Assistant Examiner*—V. K. Rising
*Attorney, Agent, or Firm*—Joseph A. Geiger

[57] ABSTRACT

A method for the cold rolling of narrow flat lands on the cylindrical surface of heat exchanger tubing, just prior to the winding onto the tubing of one or more metal strips for the production of finned tubing, the device having pressure rollers on pressure levers carried by a journalled supporting spindle which rotates with the tubing, and a control sleeve inside the hollow spindle which, under the action of a linear actuator, interrupts the rolling action as desired, while the winding operation continues.

6 Claims, 4 Drawing Figures

METHOD FOR THE COLD WORKING OF HEAT EXCHANGER TUBING FOR THE ATTACHMENT OF SPIRAL FINS

BACKGROUND OF THE INVENTION

1. Field of the Invention

The present invention relates to methods for the manufacture of finned heat transfer tubing, and, more particularly, to a method for the cold working of heat transfer tubing prior to the attachment thereto of a spiral fin, or fins, as one or several continuous lengths of metal strip are wound around the tubing.

2. Description of the Prior Art

The manufacture of heat transfer tubing through the winding of fins onto smooth tubing is known and practiced in a variety of ways. Though initially employed only in connection with non-ferrous tubing and fin profiles, because of the inferior ductility of steel strip, winding methods have been developed recently by which steel strip material can be wound onto tubing of a round or oval cross section. Such a method and device are disclosed in U.S. patent application Ser. No. 569,887, filed Apr. 21, 1975.

The present invention addresses itself to the specific problem which arises in connection with the winding of fins onto round tubing, when the winding tension on the last fin spiral is relaxed, either as the result of termination of the winding operation, or as the result of strip fracture. When this happens, the fin coil opens and uncoils a very small amount from its wound position, as a result of its residual bending elasticity. In the case of certain materials, especially steel strip, this residual elasticity may be just enough to eliminate the frictional engagement between the supporting edge of the fin coil and the smooth outer surface of the round tubing, thereby rendering the tubing unsuitable for its intended use.

In the past, this problem has been dealt with by attaching the metal strip to the tubing with spot welds at the beginning and end of each winding operation and prior to cutting of the metal strip. The same spot welding operation was then also necessary later, when a length of finished tubing was cut in two, for example.

However, no counter-measures against the accidental unwinding of the fin coil in the case of strip fracture during the winding operation have been available up to now. Obviously, such strip fractures can lead to very serious interruptions in the manufacturing process, when the fin coil on the tubing snaps open. The distance over which such an opening action may extend can amount to several yards of tubing. Such occurrences are not only costly in terms of time lost, they also can lead to sizable material losses.

SUMMARY OF THE INVENTION

It is a primary objective of the present invention to provide a solution of the above-mentioned prior art problem by suggesting an operating method which, when used in conjunction with the winding of fins onto heat exchanger tubing, will positively prevent the uncoiling of the fin coil, or coils, either at the termination of a winding operation, or in the case of accidental fracture of the strip material during the fin winding operation.

The present invention proposes to attain the above objective by suggesting a novel method for cold working the round tubing just prior to the winding operation of the fins in such a way that at least one flattened surface portion or land is produced on the periphery of the tubing, which thereby will give the tubing periphery and the supporting edge of the fin coil a slightly non-circular outline, sufficient to prevent the uncoiling of the fin coil in the absence of a winding tension or attachment weld on the last fin spiral.

In a preferred embodiment of the invention, the tubing is cold worked to have two or four diametrically opposite peripheral lands. The cold working operation is preferably a cold rolling operation, producing a land of approximately 1 mm peripheral width.

The establishment of one or several longitudinal lands on the periphery of the tubing, while not affecting the winding operation, nevertheless produces sufficient deviation from a truly circular peripheral outline of the tubing that the inner edge of the wound fins, by following the slightly non-circular outline, creates a rotational engagement between the fin coil and the tubing surface — in addition to its frictional engagement — which will prevent the uncoiling of the wound fin. Even a land as narrow as 1 mm, for example, with its extremely small deviations from a truly circular contour, was found to produce sufficient deviation from the regular curvature of the supporting edge of the fin that the dreaded uncoiling would be positively prevented.

The need for only a minimal land width on the tubing makes it possible to use a most simple and inexpensive method of producing such a land in a cold working operation. The production of preferably two or four such lands on the tubing circumference, in addition to improving the holding features outlined further above, has the advantage of allowing for the cold rolling operation to take place under force equilibrium, and even while the tubing is being rotated in the fin winding operation.

The present invention utilizes a novel device for the performance of the proposed cold working method in conjunction with the fin winding operation. The proposed novel device features a console, to be mounted on the fin winding machine, which rotatably supports a hollow spindle with a plurality of radially adjustable pressure rollers. The spindle with its pressure rollers thus revolves together with the tubing, impressing on it the desired peripheral lands, as the tubing advances axially through the device. The hollow spindle being preferably supported by ball bearings, no drive is necessary, since sufficient rotational engagement is provided by the rolling action on the tubing.

In a further development of the invention, the proposed device for cold rolling the rotating tubing also features means for selectively disengaging the pressure rollers from the tubing, for the creation of longitudinal interruptions in the lands on the tubing surface. The invention suggests to obtain such disengagement and reengagement by remote control, with the help of a likewise rotating control sleeve which is arranged inside the supporting spindle. This control sleeve, being axially movable, determines the position of the pressure rollers in relation to the tubing. The axial movement of the control sleeve is preferably obtained by means of a non-rotating control collar which is engaged by a control lever operated preferably by a linear actuator.

The selectively controllable interruption of the rolling operation on the tubing makes it possible to arrange certain length portions on the tubing without the novel peripheral lands. On these length portions, the continuously wound coil can then be readily removed by simply clipping the fin or fins at the appropriate places. The arrangement of a remotely operable control mechanism makes it possible to provide such non-rolled length portions at predetermined places of every length of tubing, without the need for interrupting the winding operation which takes place at high speeds.

In a preferred embodiment of the proposed novel device, the supporting spindle for the pressure rollers carries four pivotable pressure roller levers. Each lever carries on one extremity a pressure roller and is engaged on its opposite extremity against a pressure cam on the control sleeve. The engagement with the pressure cam is preferably made adjustable in the radial sense, by means of an intermediate pressure screw. The pressure rollers themselves may be simple ball bearings. Alternatively, the pressure rollers may also be special hardened rollers with a surface profile other than cylindrical. Between the four pressure levers and the supporting spindle may be arranged compression springs which lift the pressure rollers from the surface of the tubing, when the control sleeve is retracted to the disengaged position.

The control sleeve executes its axial control movement while being rotatably entrained by the supporting spindle, carrying for this purpose a non-rotating control collar, connected to the sleeve by means of a ball bearing. To the control collar is attached a forked control lever which, while being pivoted on one extremity, is attached by its other extremity to a linear actuator, preferably a double-acting pneumatic cylinder. The device is thus remotely switchable between its engaged and disengaged positions, without the need for interrupting the winding operation.

BRIEF DESCRIPTION OF THE DRAWINGS

Further special features and advantages of the invention will become apparent from the description following below, when taken together with the accompanying drawings which illustrate, by way of example, a preferred embodiment of the invention, represented in the various figures as follows.

DESCRIPTION OF THE PREFERRED EMBODIMENT

Figure 2:
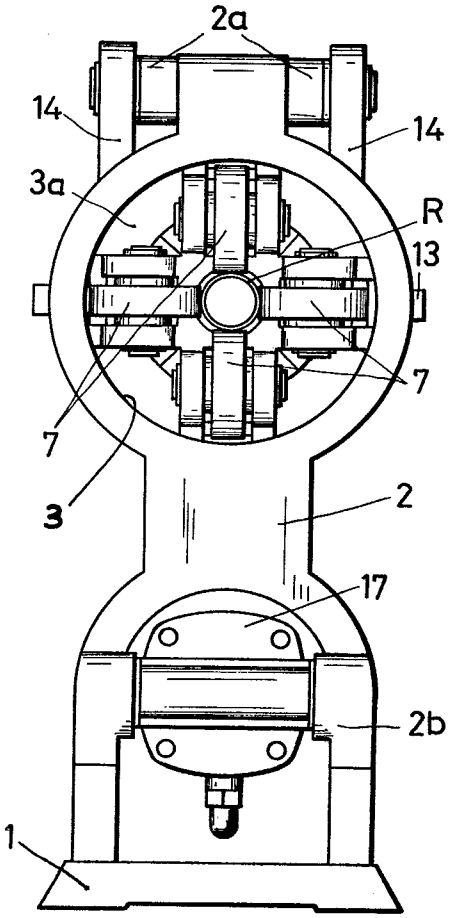
FIG. 2 is a side view of the device of FIG. 1.
Figure 1:
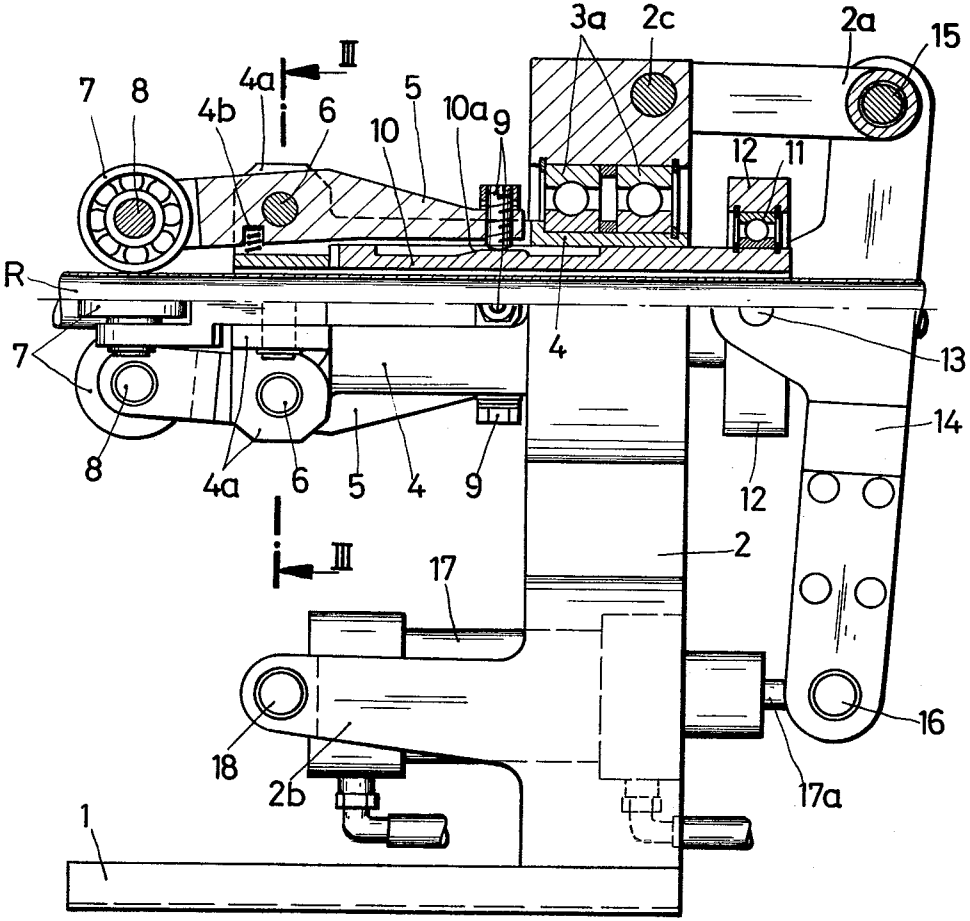
FIG. 1 shows, in a partially cross-sectioned elevational view, a rolling device embodying the present invention.
Figure 3:
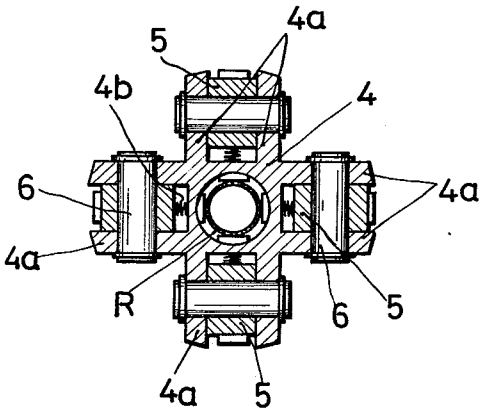
FIG. 3 is a cross section along line III—III of FIG. 1.

Referring to FIGS. 1 and 2 of the drawing, there is illustrated a device for the cold rolling of heat exchanger tubing, before fins are applied to the tubing in a winding operation. An example of a machine which automatically winds one or several fins around a rotating length of tubing is disclosed and described in U.S. patent application Ser. No. 569,887, filed Apr. 21, 1975. Such a machine, resembling a lathe, has a spindle stock with a drive chuck on a hollow drive spindle which clamps and rotates a length of tubing. On the elongated bed of the machine is arranged a winding carriage which, while guiding one or several metal strips towards the rotating length of tubing from supply spools mounted on the carriage, advances in the axial direction, thereby winding one or several endless helical fins into a fin coil around the heat exchanger tubing. The illustrated embodiment of the invention is suitable to be mounted on such a winding carriage.

The device of the invention consists essentially of a console 2 with a flat mounting base 1 by means of which it may be attached to a fin winding machine, as described above. In the upper portion of the console 2 is arranged a large horizontal journal bore 3 inside which is rotatably mounted, with the aid of two ball bearings 3*a*, a hollow supporting spindle 4. The device is so arranged on the winding carriage of the fin winding machine that the longitudinal axis of the hollow supporting spindle 4 coincides with the longitudinal axis of the winding machine, so that the spindle surrounds the heat exchanger tubing R at a place ahead of the point where the fins are wound around the tubing.

The supporting spindle 4 carries on one of its axial extremities a spindle head consisting of four pairs of radially extending ears 4*a*, arranged at 90° angular spacing. Each pair of ears 4*a* carries a transverse pivot pin 6, serving as a pivot support for a longitudinally extending pressure lever 5. The four pressure levers 5 have forked outer extremities on which they carry four pressure rollers 7 on roller pins 8. These pressure rollers may simply be ball bearings, as is exemplified in FIG. 1. The inner extremities of the pressure levers 5 carry radially inwardly pointing adjustable pressure screws 9. Compression springs 4*b*, positioned between the pressure levers 5 and a supporting surface of the spindle 4, urge the pressure rollers away from the tubing R.

Engaging the four adjustable pressure screws 9 is a hollow control sleeve 10 which is arranged inside the hollow supporting spindle 4. While rotating with the latter, the control sleeve 10 is axially movable relative to the spindle. This axial movement is used to engage suitable pressure cams 10*a* against the pressure screws 9 of the levers 5, so that an axial movement of the control sleeve 10 engages the pressure rollers 7 radially against the outer surface of the tubing R. A retracting movement of the control sleeve 10, accordingly, disengages the four pressure rollers 7 from the tubing R with the aid of the compression springs 4*b*. As long as the rollers 7 are pressed against the tubing R, the rotation of the latter is imparted to the entire rolling assembly consisting of the supporting spindle 4, pressure levers 5, rollers 7, and control sleeve 10. The ball bearings 3*a* facilitate this rotation, while holding the assembly in place.

In order to produce the axial control movements on the control sleeve 10 during rotation, the latter carries on its rearward extremity a non-rotating collar 12 which is supported and axially retained on the sleeve 10 by means of a ball bearing 11. On opposite sides of the control collar 12 are arranged two connecting pins 13 which are engaged by laterally spaced ears of a control lever 14. The latter, as FIG. 1 shows, extends across the axis of the tubing R, being pivotably supported on one side thereof by means of a supporting link 2*a* and pivot pins 2*c* and 15, while being connected on the opposite side of the rotating assembly to a linear activator 17. The latter is preferably a double-acting pneumatic cylinder having its piston rod 17*a* connected to the control lever 14 by means of a pivot pin 16 and the opposite end of the cylinder connected to suitable support arms 2*b* of the console 2 by means of an anchoring pin 18.

Figure 4:
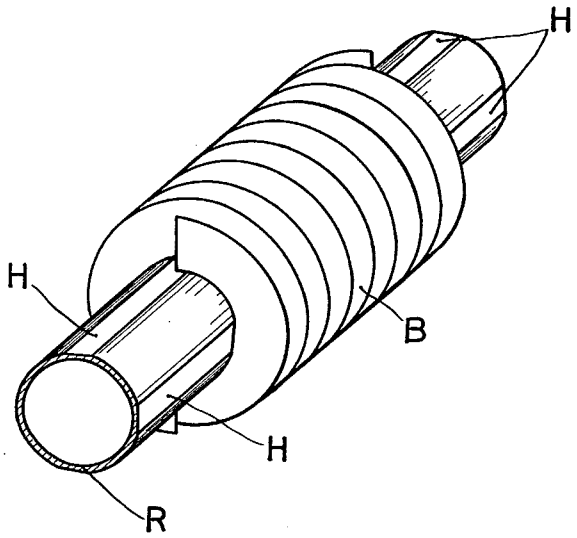
FIG. 4 shows, on a piece of finned tubing, the result of the method of the present invention.

The operation of the illustrated novel device is as follows:

A length of heat exchanger tubing R, onto which are to be wound fins in the manner shown in FIG. 4, for example, is supported and continuously rotated in a fin winding machine, while one or more metal strips are guided against the rotating tubing and wound around the circumference of the latter in a helical pattern. This pattern is obtained as a result of a longitudinal movement of the winding carriage during rotation of the tubing. Of course, it would also be possible to maintain the winding apparatus in a stationary position, while the rotating tubing R is simultaneously rotated and advanced in the axial direction along a helical path. The device of FIG. 1 is preferably arranged a short distance ahead of the point where the metal strip or strips B (FIG. 4) are wound around the tubing.

The device, as illustrated, is shown in its operating position with the tubing R already introduced into the machine. In this position, the pressure screws 9 of the four pressure levers 5 are engaged against the high points of four control cams 10 which are arranged in longitudinal grooves of the control sleeve 10. The pressure screws 9 are so adjusted that the pressure rollers 7 on the opposite extremities of the four levers 5 press against the outer surface of the tubing R to create four narrow flattened lands H (see FIG. 4) on the circumference of the tubing R, as the tubing advances axially through the rolling device, or the latter advances over the tubing, respectively. Since no relative rotational displacement takes place between the tubing R and the pressure rollers 7 during the rolling operation, the lands H are oriented in the longitudinal direction. The absence of any friction, other than the rolling friction of the journal bearings 3*a* and of the pressure rollers 7 minimizes the stress and wear on the rolling device.

Both the center position of the tubing R in relation to the four rollers 7 and the pressure exerted by the latter against the tubing are readily adjustable by means of the four adjustable pressure screws 9. The pressure exerted between the two pairs of opposing pressure rollers 7, in turn, determines the circumferential width of the lands H. It has been found that a land width of approximately 1 mm on heat exchanger tubing of 25 mm diameter is adequate for an exemplary application of this invention. Thus, although the narrow lands H involve a minimal radial deformation, creating barely discernable corners between the lands and the remaining arcuate portions of the circular tubing circumference, these deviations from the true circular circumference are sufficient to provide the desired engagement profile between the tubing R and the fins B wound around it. An example of heat exchanger tubing having four (dimensionally exaggerated) lands H on its circumference is illustrated in FIG. 4. This example features two helically wound fins B.

For reasons of productive efficiency, it is desirable to apply the fins to the tubing in a continuous high-speed winding operation, using the maximum length of tubing available. It may thus become desirable to arrange certain length portions on each piece of tubing, where the — normally undesirable — uncoiling tendency of the fins is preserved for easier removal of a portion of the fins, following clipping of the fins at both ends of the length portion from which they are to be removed. For this purpose, the device of the invention provides that the engagement of the pressure rollers 7 against the rotating tubing R can be released while the high speed winding operation goes on, by simply operating the control cylinder 17 so that its piston rod 17*a* moves the control lever 14 away from the console 2. This movement is transmitted to the control sleeve 10, via its control collar 12 and the connecting pin 13, so that the pressure cams 10*a* are axially withdrawn from under the pressure screws 9, thereby allowing the latter to move radially inwardly, while the opposite extremities of the levers 5 with their pressure rollers 7 move radially outwardly under the bias of the compression springs 4*b*.

A simple reverse movement of the double-acting cylinder 17 reengages the control cams 10*a* underneath the pressure screws 9, for a resumption of the cold rolling operation on the surface of the tubing R. It is thus possible to quickly interrupt and/or resume the cold rolling operation at will, or in accordance with a specific program, while the fin winding operation proceeds uninterrupted at full speed. The arrangement of ball bearings for the support of the hollow spindle 4 and for the mounting of the control collar 12 minimizes the tendency of the pressure roller 7 to slide in the circumferential direction in relation to the rotating tubing R. In fact, during short interruptions of the cold rolling operation, the rotatable rolling assembly will continue its rotation, without being driven by the tubing R, until it is reengaged against the tubing R.

It should be understood, of course, that the foregoing disclosure describes only a preferred embodiment of the invention and that it is intended to cover all changes and modifications of this example of the invention which fall within the scope of the appended claims.

I claim the following:

1. In a method involving the production of finned heat transfer tubing, where one or more continuous metal strips are wound onto a length of smooth round tubing, as the latter is rotated, so as to create one or more helical fins on the tubing, the improvement comprising the step of:

shaping the cylindrical outer surface of the tubing prior to said winding operation, so as to form thereon at least one circumferentially narrow land which, in the subsequent winding operation, produces a corresponding very small inward deviation from the true circular inner curvature of the wound fins, thereby causing the non-circular portions of the wound fins to engage a longitudinal edge of the land, so as to prevent rotation of the fins relative to the tubing surface, independently of frictional engagement.

2. An improved method as defined in claim 1, wherein the step of shaping the tubing surface is performed by cold rolling the tubing under at least one pressure roller which moves in the axial direction relative to the length of tubing.

3. An improved method as defined in claim 1, wherein the step of shaping the tubing surface is performed by cold rolling the tubing between at least one pair of opposing pressure rollers which move in the axial direction relative to the length of tubing, thereby producing at least two lands.

4. An improved method as defined in claim 1, wherein the step of shaping the tubing surface is performed in conjunction with the fin winding operation, on the rotating tubing, and just ahead of the location where the fin winding takes place; and said shaping step is performed by cold rolling the tubing with the aid of pressure rollers which revolve with the rotating tubing, while moving in the axial direction relative to the tubing.

5. An improved method as defined in claim 4, wherein the step of shaping the tubing surface is adjusted to produce diametrically opposite flat land on the tubing circumference of approximately 1 mm width.

6. An improved method as defined in claim 4, comprising the additional step of selectively interrupting the cold rolling action by temporarily lifting the pressure rollers from the tubing surface, without interrupting the fin winding operation.

* * * * *